US005094457A

United States Patent [19]

Kinoshita

[11] Patent Number: 5,094,457

[45] Date of Patent: Mar. 10, 1992

[54] LOW AXIAL INERTIA GOLF CLUB

[76] Inventor: Frank Kinoshita, P.O. Box 3164, Rancho Santa Fe, Calif. 92067

[21] Appl. No.: 705,080

[22] Filed: May 24, 1991

[51] Int. Cl.[5] ..... A63B 53/04; A63B 53/08

[52] U.S. Cl. ..... 273/167 G; 273/167 F; 273/169; 273/80 C

[58] Field of Search ..... 273/167 R, 167 F, 169, 273/80 C, 167 G, 80 A, 77 R

[56] References Cited

U.S. PATENT DOCUMENTS

| | | | |
|---|---|---|---|
| 1,993,982 | 3/1935 | Glover | 273/167 F |
| 3,693,978 | 9/1972 | East | 273/167 F |
| 3,860,244 | 1/1975 | Cosby | 273/167 F |
| 3,941,390 | 3/1976 | Hussey | 273/167 F |
| 3,947,041 | 3/1976 | Barber | 273/167 G |
| 3,980,301 | 9/1976 | Smith | 273/80.2 |
| 4,063,733 | 12/1977 | Benedict | 273/167 G |
| 4,063,737 | 12/1977 | Tom et al. | 273/174 |
| 4,247,105 | 1/1981 | Jeghers | 273/77 A |
| 4,322,083 | 3/1982 | Imai | 273/167 F |
| 4,325,553 | 4/1982 | Taylor | 273/171 |
| 4,420,156 | 12/1983 | Campau | 273/169 |
| 4,471,961 | 9/1984 | Masghati | 273/175 |
| 4,512,577 | 4/1985 | Solheim | 273/77 A |
| 4,762,322 | 8/1988 | Molitor | 273/77 A |
| 4,809,983 | 3/1989 | Langert | 273/167 E |
| 4,895,367 | 1/1990 | Kajita | 273/77 A |
| 4,958,834 | 4/1990 | Colbert | 273/77 A |

*Primary Examiner*—Edward M. Coven
*Assistant Examiner*—Steven B. Wond

[57] ABSTRACT

This invention relates to a category of golf clubs ranging from the driver to a seven wood, and ranging from a one iron to high lofted sand wedges. Each club within this category of golf clubs will provide superior playing characteristics compared to prior art golf clubs because of the lower axial inertia exhibited by the club heads of the present invention. For this invention, lower axial inertia is defined as lower rotational inertia about the club shaft longitudinal axis. The lower axial inertia is achieved by a reduction of the club head center of gravity to club shaft centerline distance when compared to a prior art club head. To achieve said reduction of the club head center of gravity to club shaft centerline distance, the present invention will utilize a special club head heel-sole-toe weighting configuration and a special method of hosel to club head heel attachment. A dictum of golf technique is that the club face should remain parallel and on the swing plane except near the impact point if the desired delayed hit is to be achieved. This means that the golfer must rapidly rotate the club shaft 90 degrees about its longitudinal axis in approximately 58 milliseconds just prior to impact. The low axial inertia club head of the present invention will facilitate the golfer in achieving the desired delayed hit.

5 Claims, 5 Drawing Sheets

FIG IA PRIOR ART

FIG 4A
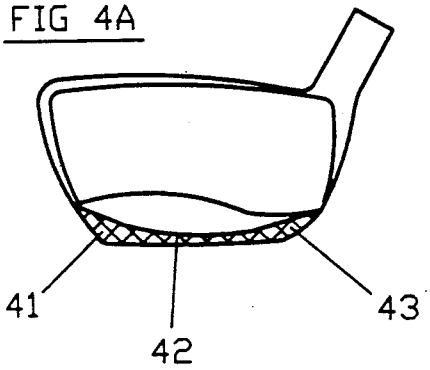
FIG 5A
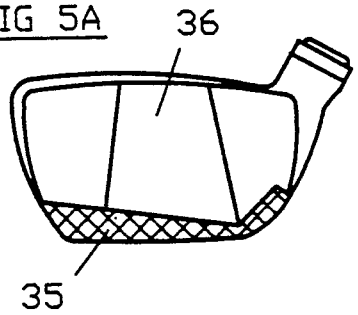
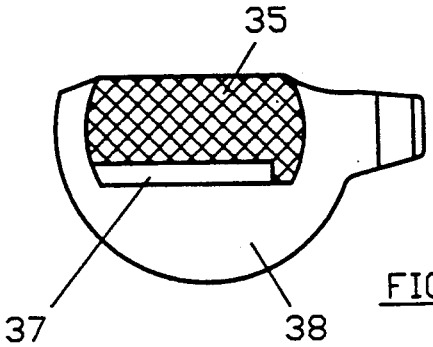
FIG 5B
FIG 4B
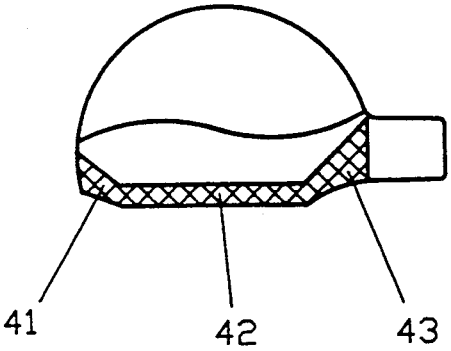
FIG 5C
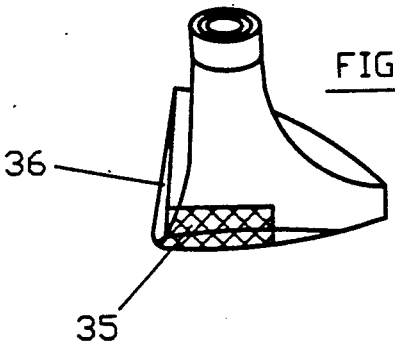
FIG 4C
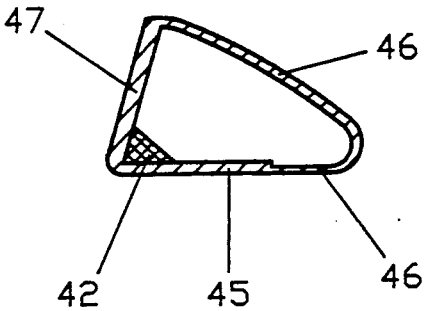
FIG 5D
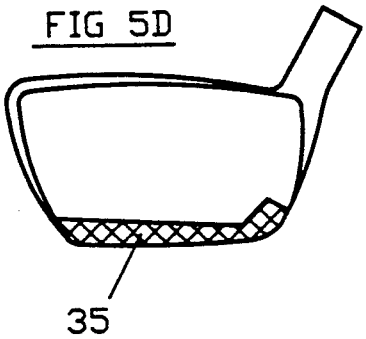

LOW AXIAL INERTIA GOLF CLUB

FIELD OF THE INVENTION

The present invention relates in general to a category of golf clubs and in particular to the unique design of the club heads, used to produce said category of golf clubs.

BACKGROUND OF THE INVENTION

Each golf club within said category of golf clubs will provide superior playing characteristics compared to prior art golf clubs because each golf club of the present invention exhibits lower axial inertia than prior art golf clubs. Where lower axial inertia is defined as lower rotational inertia about the club shaft longitudinal axis. All golf clubs ranging from the driver through high lofted sand wedges are embodied in the present invention. The club heads of the present invention features:

A. Uniquely positioned hosel centerline relative to the club head heel

B. Unique heel-sole-toe weighting configuration

C. Predetermined sequence of golf club head loft angle, club face curvature, lie angle and leading edge progression D. Unique golf club head appearance A dictum of golf technique is that the club face should remain parallel to and on the swing plane except near the impact point. To remain within said dictum and to obtain the desired delayed hit, the golfer must rapidly rotate the club shaft 90 degrees about its longitudinal axis just prior to impact. The delayed hit is defined as the condition where the golfer is able to maintain the club face parallel to and on the swing plane until approximately the last 90 degrees of swing arc just prior to impact with his wrists in a fully cocked position and then while releasing from said cocked position rotate the club shaft 90 degrees about its longitudinal axis and then make proper contact with the golf ball. To facilitate this rapid rotation of the club shaft, the present invention will provide lower axial inertia golf clubs when compared to prior art golf clubs. Hereafter, in the discussion of the present invention, the term shaft axis is defined as the club shaft longitudinal axis and the term axial inertia will be defined as the rotational inertia about the club shaft longitudinal axis. Prior art does not address this important issue of providing a low axial inertia golf club to aid the golfer in achieving said desired delayed hit, nor does the prior art discuss any heel-sole-toe weighting configuration constraints on the club head design to achieve a low axial inertia golf club. The present invention lowers the axial inertia by moving the club head center of gravity in closer to the shaft axis centerline. The reduction of the axial inertia is achieved by placing the following configuration constraints on the design of the club heads of the present invention:

1. The hosel centerline, which is an extension of the shaft axis, shall be located away from the extremity of the club head heel and towards the toe end to accomodate the unique heel weighting of the present invention but in no case shall said hosel center line be located further away from the heel extremity than 0.625 inch. Prior art U.S. Pat. No. 3,860,244 refers to said 0.625 inch dimension, but said prior art patent does not address the issue of heel-sole-toe weighting to obtain the unique club head characteristics of the present invention. With the exception of this single dimensional similarity, the differences in the concept of said prior art patent and the present invention are overwhelming.

2. Heel weighting whether it is intrinsic or extrinsic to the club head shall be deposited on the side of the shaft axis opposite to the impact side of said shaft axis. Said heel weighting shall be deposited close to the club head sole to maintain a low club head center of gravity. Prior art does not address the fact that the heel weighting should be located on the side of the shaft axis opposite to the impact side in order to lower the club head axial inertia. Nor does prior art discuss the advantage of having heel weighting deposited close to the sole in order to obtain a low club head center of gravity.

3. Sole weighting on the wood club heads whether it is intrinsic or extrinsic to the club head shall be deposited towards the impact plane to obtain a club head center of gravity location which is closer to the impact plane than prior art wood club heads. "The impact plane is defined as a vertical plane that intersects the golf ball impact point on the club face and is perpendicular to the horizontal component of the golf ball launch direction." A center of gravity location which is closer to the impact plane will reduce the gear effect side spin caused by off-line swing path impacts. Prior art does not address the importance of having the club head center of gravity close to the impact plane in regards to reducing the gear effect side spin. Gear effect side spin is well discussed in U.S. Pat. No. 4,471,961.

4. Toe weighting whether it be intrinsic or extrinsic to the club head shall be used to reduce the adverse effects of off-center impacts but not to an extent that the basic intent of the invention is compromised, where said basic intent is to lower the club head axial inertia. Said toe weighting shall be deposited close to the impact plane to minimize gear effect side spin caused by off-line swing path impacts, and deposited close to the club head sole to maintain a low club head center of gravity. A low center of gravity will tend to yield a low axial inertia club head. Prior art does not discuss the important relationship between low center of gravity and low axial inertia club heads.

5. The crown apex of wood club heads shall be further forward towards the club face when compared to prior art wood club heads, and whereby the crown tapers off rapidly from its apex towards the rear of the club head to obtain a low profile club head which tends to lower the club head center of gravity. Prior art does not discuss this method of crown apex placement to obtain a low club head center of gravity.

The object of this invention is to:

1. Provide a golf club head design which improves the playing characteristics of both woods and irons by reducing the axial inertia of said golf club head. Low axial inertia club heads will be produced by reducing the distance between the center of gravity to the shaft axis centerline. Prior art does not address the importance of low axial inertia club heads in regards to the achievement of the delayed hit.

2. Provide a low club head center of gravity. This low center of gravity will aid the present invention's goal of obtaining low axial inertia club heads. Prior art does not discuss the relationship between club head low center of gravity and low axial inertia.

3. Provide one configuration of golf clubs whereby the iron club heads and the offset hosel wood club heads will have a hosel centerline which intersects a horizontal line which is on the impact plane and where said horizontal line intersects the expected impact point. This predetermined relationship of the hosel to the club head will provide the golfer with a consistent feel for precisely when the club head will make contact with the ball relative to the position of the shaft axis. Prior art does not specifically discuss said predetermined relationship and its subsequent advantage.

4. Provide a wood golf club head wherein all the heel-sole-toe weighting material is deposited as close to the impact plane as practical. With said heel-sole-toe weighting material up near the impact plane, a reduction of gear effect side spin on off-line swing path impacts will be realized when using a wood golf club of the present invention. Prior art does not discuss the issue of providing a club head center of gravity close as practical to the impact plane in order to minimizes the gear effect side spin.

SUMMARY OF THE INVENTION

The present invention provides for a category of golf clubs progressing from the driver to the wedge in which loft angle, lie angle; club swing weight and length are coordinated. Each wood club head in this invention has common design features including a club head center of gravity which is closer to the shaft axis centerline, closer to the impact point plane, closer to the sole than prior art club heads. Said wood club head design features are obtained by an unique hosel connection to the heel of the club head, unique heel weighting deposited on the opposite side of the shaft axis relative to the ball impact side, sole weighting deposited as close as practical to the impact plane and toe weighting deposited as close as practical to the bottom of said wood club head. Each iron club head of the present invention has common design features including a club head center of gravity which is closer to the shaft axis centerline, and closer to the sole than prior art club heads. Said iron club head design features are obtained by an unique hosel connection to the heel of the club head, unique heel weighting deposited on the opposite side of the shaft axis relative to the ball impace side, and toe weighting deposited as close as practical to the bottom of the club head. Using the low axial inertia club heads of the present invention, the golfer will find it easier to achieve a delayed hit which requires a rapid rotation of the club head about the shaft axis just prior to impact. The delayed hit which is the essence of any good golf swing requires that the golfer maintain a cocked wrist position until approximately the last 90 degrees of swing arc just prior to impact. In this cocked wrist position the club face is parallel to and on the swing plane, but an impact the club face must be perpendicular to the swing plane. Assuming an average club head speed of 75 miles per hour through said last 90 degrees of swing arc, the golfer must rotate the club shaft 90 degrees about its longitudinal axis in approximately 58 milliseconds. The lower axial inertial provided by the present invention will assist the golfer in achieving this 90 degrees of shaft rotation in 58 milliseconds. Lower axial inertia club heads of the present invention is obtained by reducing the center of gravity to shaft axis centerline distance and thus reduce the Moment of Force about the shaft axis. The unique features that are considered characteristic of the present invention are set forth in the appended claims. The invention will be readily understood from the following description when read in connection with the accompanying drawings. The term wood club head is defined for the present invention as any club head, not necessarily made of wood, having an exterior form factor somewhat similar to a conventional solid wood club head or as any club head with a loft angle of less than 27 degrees and visually different in appearance from a conventional iron club head.

BRIEF DESCRIPTION OF THE DRAWINGS

FIGS. 1A, 2A and are diagrams which illustrates the frontal distance between the club head center of gravity and the shaft axis of two prior art drivers.

FIGS. 4A, 4B and 4C illustrates three views of the weighted heel, toe and sole locations for a hollow wood club head embodying the present invention.

FIGS. 5A 5B and 5C illustrates three views of a wood club head utilizing one form of a heel-sole-toe weighting structure embodying the present invention. Said wood club head is constructed of laminated maple persimmon or material of similar densities.

FIG. 5D is a front view of a hollow wood club head utilizing the heel-sole-toe weighting structure embodying the present invention. The hollow wood club head body is constructed of aluminum, or material of similar density.

9A and 9B are two views of a 30 degree iron club head embodying the present invention.

Figure 9A:
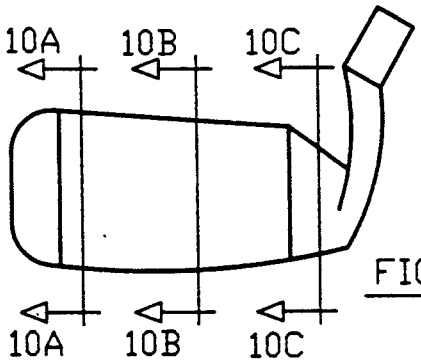
Figure 9B:
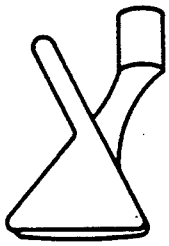
Figure 10A:
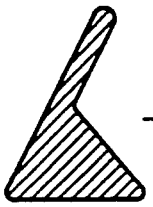
Figure 10B:
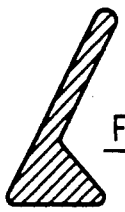
Figure 10C:
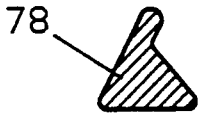

FIGS. 10A, 10B and 10C are three sectional views of the 30 degree iron club head shown in FIGS. 9A, and 9B.

DESCRIPTION OF PREFERRED EMBODIMENTS

Figure 1B:
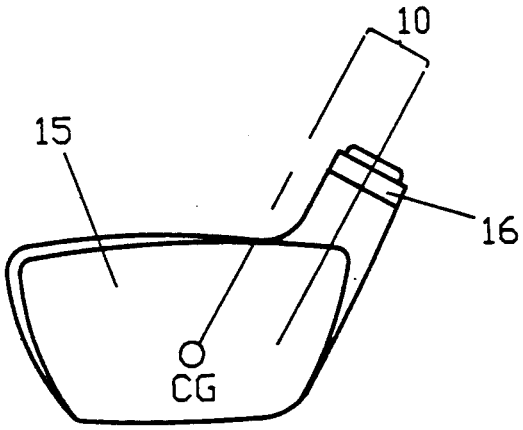
FIGS. 1B and 2B are diagrams which illustrates the frontal distance between the club head center of gravity to the shaft axis for two drivers embodying the present invention.
Figure 1C:
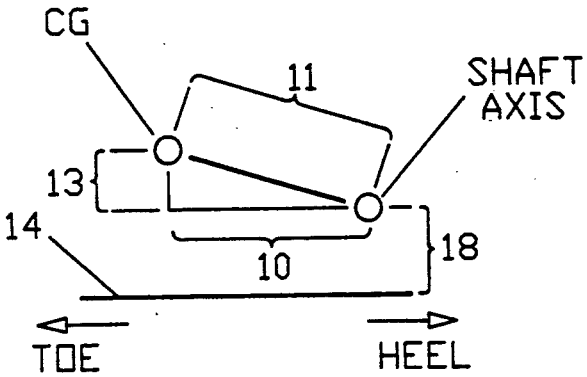
FIG. 1C is a diagram of the distances as viewed from the shaft axis and depicts how the resultant distance from the shaft axis to the club head CG is obtained.

Referring to FIGS. 1A, 1B and 1C, the difference in the frontal distance 10 from the center of gravity CG to the shaft axis between a good prior art persimmon club head and the present invention club head will be noted. The distance 10 was measured to be approximately 0.96 inch for said good prior art persimmon club head and the distance 10 for a laminated persimmon club of the present invention has been calculated to be 0.64 inch. To obtain the resultant distance from the CG to the shaft axis, we must also consider the distance 13 as shown in FIG. 1C. The impact plane is shown as 14 and the distance from the impact plane to the shaft axis is shown as 18. All distances shown in FIG. 1C are perpendicular to the longitudinal axis of the shaft. On said prior art persimmon club head, distance 13 was measured to be 0.50 inch which yields a resultant CG to shaft axis distance 11 of 1.08 inches. The club head of the present invention has a calculated distance 13 of 0.065 inch which yields a resultant distance 11 of 0.64 inch. For a given club head weight, it can be readily seen how a reduction in the Moment of Force about the shaft axis has been achieved for the club head of the present invention. The Moment arm of the prior art persimmon club head is 1.08 inches whereas the Moment arm of the present invention laminated persimmon club head is 0.64 inch. It can not be overemphasized how important the reduction in the Moment of Force is toward aiding the golfer in achieving the desired delayed hit. The reader will recall that in order to achieve said delayed hit, the golfer must maintain a cocked wrist position until approximately the last 90 degrees of his swing arc just prior to impact, then release his cocked wrists while rotating his wrists 90 degrees about the shaft axis in 58 milliseconds in order to make proper contact with the golf ball. It should be noted that any reduction in the Moment of Force required to achieve the necessary shaft rotation in 58 milliseconds will be beneficial to the golfer. The club face 15 is shown without regard to any detail such as grooves or inserts since they are not important to this discussion. In the present invention, as an option, a light metal band 16 is used to reinforce the hosel; therefore, whipping will not be required to help secure the shaft to the hosel if this option is used. The shaft axis to heel extremity distance 17 shall not exceed 0.625 inch for all club heads embodied in the present invention. It can be readily seen from FIGS. 1A, 1B, 2A and 2B how the lowering the position of the club head CG will also reduce the CG to shaft axis centerline distance 10.

Figure 2A:
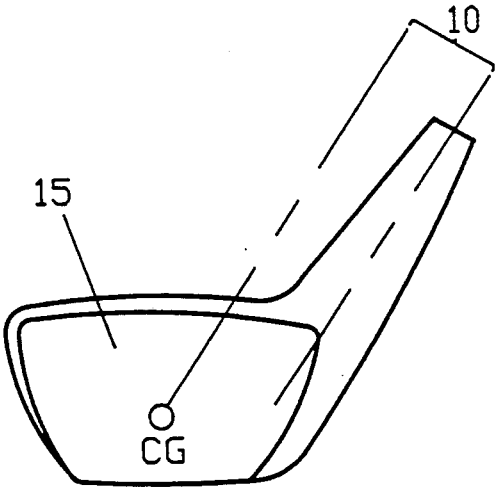
FIG 2A PRIOR ART
Figure 2A:
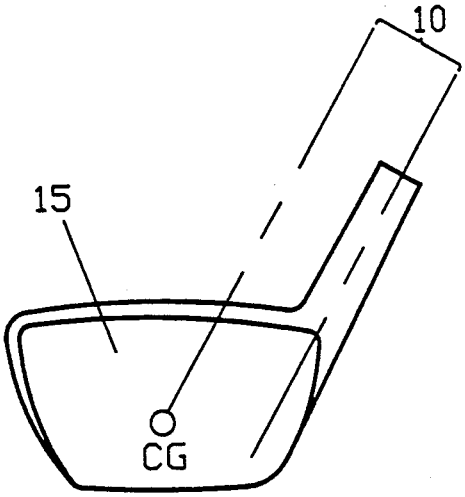
FIG 2A PRIOR ART
Figure 2B:
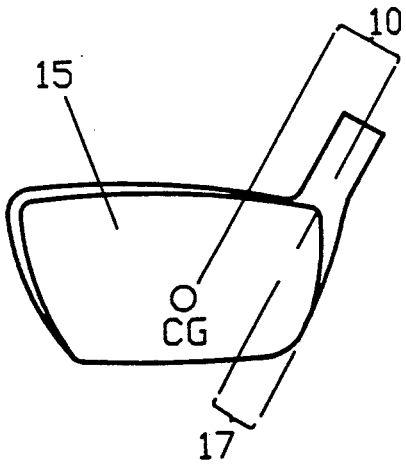

Referring to FIGS. 2A and 2B, the difference in the frontal distance 10 from the club head CG to the shaft axis between a good prior art metal wood and the present invention hollow wood club head will be noted. The distance 10 was measured to be approximately 0.94 inch for the said good prior art metal wood and the distance 10 for a stainless steel wood club head of the present invention has been calculated to be 0.69 inch. Referring to FIG. 1C, the resultant CG to shaft axis distance 11 has been calculated to be 0.96 inch for the prior art metal wood club head and 0.70 inch for said stainless steel wood club head of the present invention. Of importance, note that the Moment arm of the prior art metal club head is 0.96 inch while the Moment arm of the present invention metal club head is only 0.70 inch. The club head face 15 is shown without regard to any detail, since said detail is not important to the discussion.

Figure 3A:
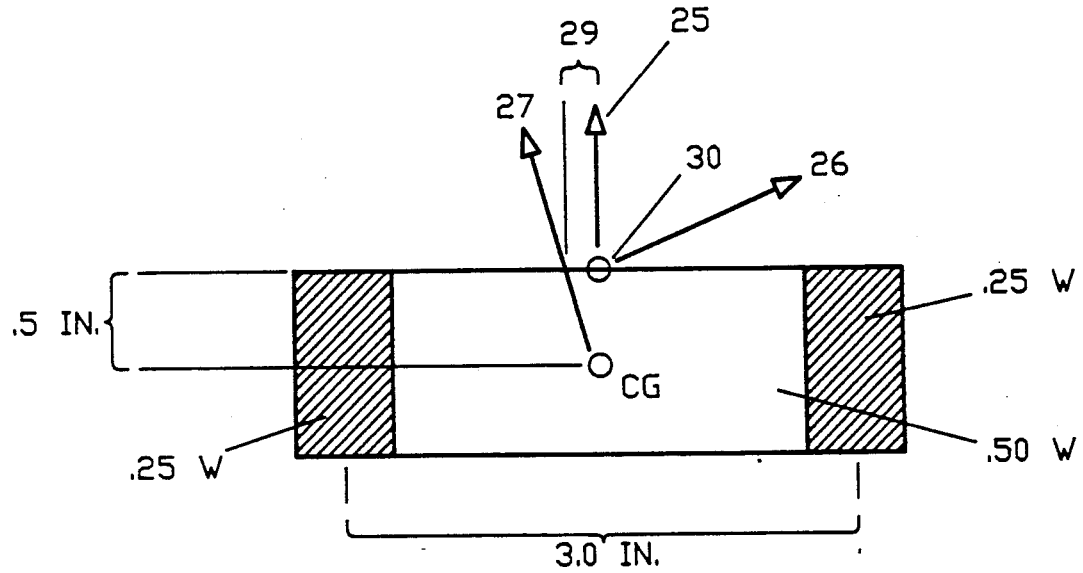
FIGS. 3A, 3B are diagrams which illustrates the different forces acting upon the impact center for club heads having different center of gravity locations. These diagrams are plan views and illustrates a hypothetical situation for a 15 degree off-line swing path angle.
Figure 3B:
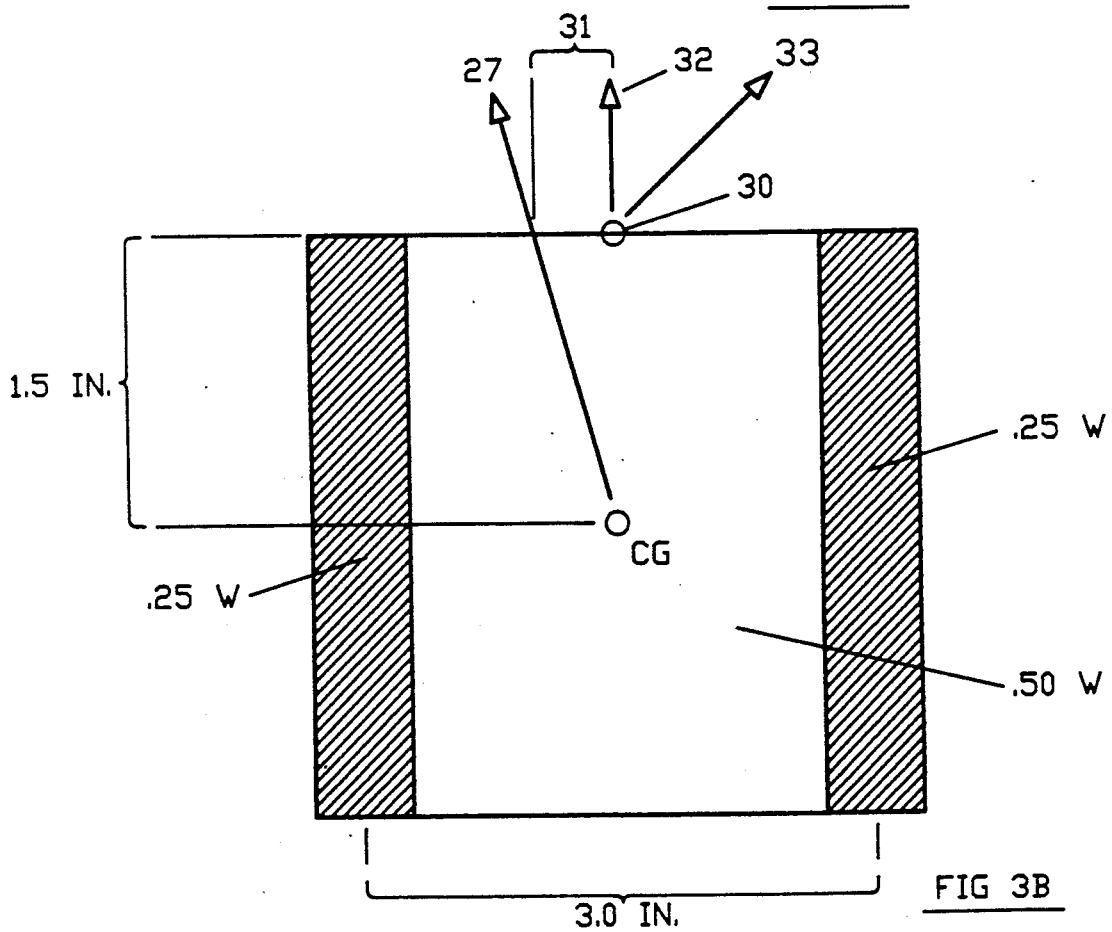

FIGS. 3A and 3B are force diagrams that depict the angle differences of the forces, 26 and 33, which causes side-spin due to gear effect for two hypothetical situations. The length of the force vectors do not have any meaning in these diagrams. Both FIGS. 3A and 3B are plan views of a club head striking a golf ball and both figures depict a condition for a 15 degree off-line swing path angle. FIG. 3A uses an assumed CG of 0.5 inch behind the impact plane and FIG. 3B uses an assumed CG of 1.5 inches behind the impact plane. These figures will show the advantage of having the club head CG close as possible to the impact plane. Starting with FIG. 3A, note that the distance 29 is 0.134 inch and is an adverse departure from the impact point 30 and is a measure of where the the club head weight W is applied relative to the impact point. The shaded areas in these figures represents the heel and toe weighted portions of the club head. The vector 27 is 15 degrees for both examples. The gear effect force component 26 is .005 W ⅞ 18.43 degrees. The total result is a force vector 25 toward the center of the golf ball of .8882 W and a gear effect side spin force component of .0047 W. However, FIG. 3B with the club head CG of 1.5 inches behind the impact point plane yields an adverse departure 31 of 0.401 inch from the impact point 30. For this situation the gear effect force component 33 is 0.1057 W @ 45 degrees. The total result is a force vector 32 toward the center of the golf ball of 0.8365 W and a gear effect side spin force component of 0.074 W. The situation of FIG. 3A has a 6.2% increase in the resultant force towards the center of the golf ball and a 93.6% decrease in the gear effect side spin component, when compared to the situation given in FIG. 3B. These force diagrams depicts the advantage of having the center of gravity CG of the club head close to the impact plane as is the case for the club heads of the present invention. The advantage is when off-line swing path impacts are encountered, more force is actually applied to the center of the golf ball and with less side spin when playing with the golf clubs of the present invention.

FIGS. 4A, 4B and 4C are drawings which shows the location of the heel 43, sole 42, and toe 41 weighting materials for a hollow wood club head of the present invention. FIG. 4A is a cut-away frontal view and FIG. 4B is a cut-away top view which show the location of the weighting materials. FIG. 4C is a sectional view of a cross section taken perpendicular to the club face and intersecting the CG of the club head shown in FIG. 4A and 4B. These figures are void of any detail since their intention is to show the location of the weighting materials that is used to achieve the unique location of the club head CG embodied in the present invention. FIGS. 6A, 6B, 6C and 6D show external views of the hollow club head shown in these figures. The intent of the present invention is to provide a wood club head CG which is closer to the shaft axis, closer to the impact plane, and closer to the sole than prior art clubs. Note that the heel weighting material 43 is deposited on the side of the shaft axis opposite to the impact side of said axis. Also note that the heel weighting material 43 and the toe weighting material 41 are deposited near the sole of the club head in order to achieve a low center of gravity. It was noted previously that lowering the center of gravity tends also to reduce the CG to shaft axis distance. Note in FIG. 4C how the sole weighting material 42 has been deposited close to the impact plane keeping the CG as close to the impact plane as practical in order to obtain a club head that exhibits reduced gear effect side spin on off-line swing path impacts. On a 11 degree straight hosel stainless steel wood club head of the present invention, the CG has been calculated to be 0.70 inch from the shaft axis, 0.60 inch above the sole, and 0.51 inch from the impact plane. Said stainless steel wood club head shall have a nominal club face 47 thickness of 0.120 inch, a sole thickness 45 of 0.06 inch and a shell thickness 46 of 0.04 inch. Alternately, said hollow wood club head material may be aluminum or any other material of similar density.

FIGS. 5A, 5B and 5C are three views of a solid wood club head embodying the present invention. Frontal, bottom and heel views respectively. The heel-sole-toe weighting structure 35 is constructed of brass or any other suitable weighting material. Said wood club head is constructed of laminated maple, persimmon or any other material of similar densities. The impact point insert 36 material shall be graphite or any other material exhibiting high resiliency and said insert shall be secured to the club head body in a position to obtain vertical symmetry about the club head CG as viewed from the front of the club head. The complete wood club head shown in FIGS. 5A, 5B and 5C, or the heel-sole-toe weighting structure 35 shown therein taken together or separately are embodied in the present invention. The remaining part of the club head sole after the installation of the heel-sole-toe weighting component is shown as 37. The underbody of the club head is shown as 38.

FIG. 5D is a front view of a hollow wood club head utilizing the heel-sole-toe weighting structure 35 embodying the present invention. Said hollow wood club body is constructed of aluminum or material of similar density and shall be relieved to accept said heel-sole-toe weighting structure 35. The complete hollow wood club head shown in FIG. 5D, or said heel-sole-toe weighting structure 35 taken together or separately is embodied in the present invention.

Figure 6A:
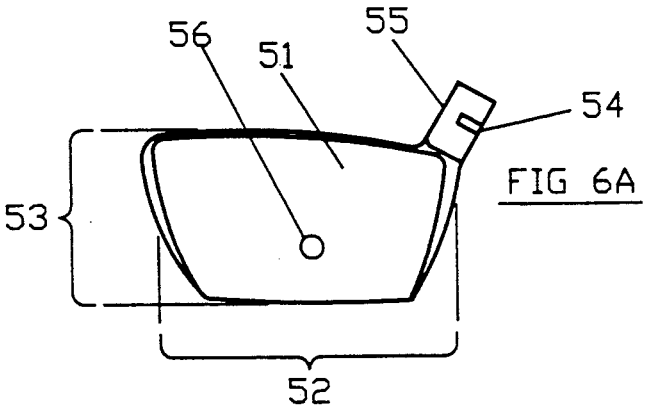
FIGS. 6A, 6B, 6C and 6D are four views of a straight hosel hollow wood club head embodying the present invention.
Figure 6B:
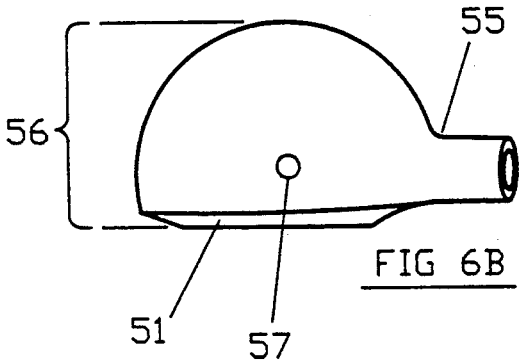
Figure 6C:
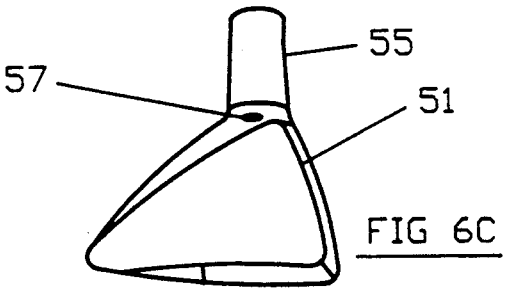
Figure 6D:
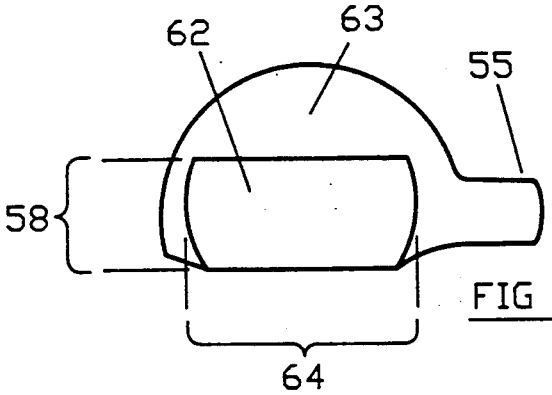

FIGS. 6A, 6B, 6C and 6D are four views of a straight hosel hollow wood driver club head embodying the present invention. FIG. 6A is a front view of a hollow wood driver club head of the present invention. Note that the club head face 51 of the said club is located closer to the shaft axis when compared to the prior art driver club head shown in FIG. 2A. The straight hosel 55 utilized on this club head is short but sufficiently long to accept a 0.75 inch penetration by the shaft. Optionally, this club head may use a pin 54 to help secure the shaft to the said straight hosel. The heel to toe distance 52 shall be 3.25 inches nominal. The sole to crown apex height 53 shall be a nominal 1.56 inches. FIG. 6B is a top view the club head of FIG. 6A. The club head face to back distance 56 is 2.25 inches nominal. A short face to back distance is embodied in the present invention to achieve a CG which is located as close the impact plane as practical. A marking such as a circle 57 shall used to mark the CG location as viewed from the top of the club. FIG. 6C is a toe end view and FIG. 6D is a sole end view of the club head. The sole front to back measurement 58 is 1.25 inches and its heel to toe measurement 64 is 2.5 inches. A low profile is embodied in the present invention to help obtain low club head center of gravity.

Figure 7A:
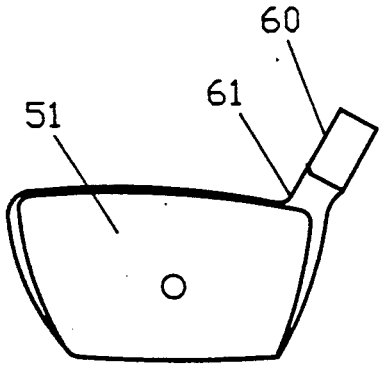
FIGS. 7A, 7B and 7C are three views of an offset hosel hollow wood club head embodying the present invention.
Figure 7B:
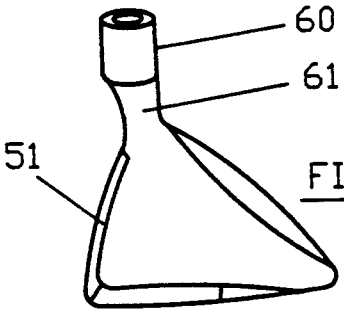
Figure 7C:
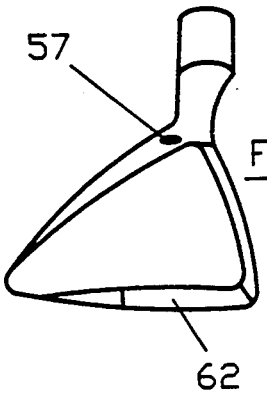

FIGS. 7A, 7B and 7C are three views of an offset hosel hollow wood driver club head embodying the present invention. The offset hosel 60 and its connection 61 to the club head heel presents a greater mass concentrated at a higher point; therefore, the offset hosel model will have a higher CG than its straight hosel counterpart. Said offset hosel model may be optionally configured in a manner such that the hosel center line shall intersect a horizontal line which is located on the impact plane and where said horizontal line intersects the impact point. The club face 51 is shown without any detail, since said detail is not important to this discussion. This club head center of gravity is calculated to be on a horizontal plane 0.65 inch above the bottom of the sole, 0.49 inch back of the impact plane and 0.80 inch from the shaft axis for this stainless steel model. This model shows a 26 percent reduction in the Moment arm when compared to the prior art stainless steel club head. Moment arm for this model is 0.80 compared to a Moment arm of 1.08 inch for the prior art club head.

Figure 8A:
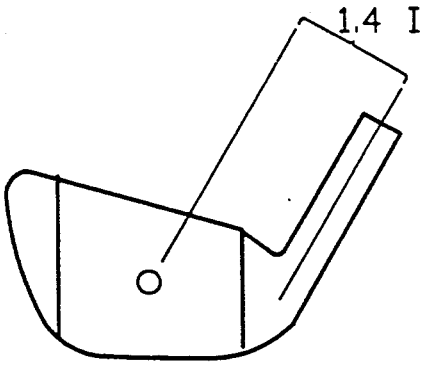
FIG 8A PRIOR ART
FIG. 8A is a frontal view of a prior art high loft angle iron club head.

FIG. 8A is a front view of a high loft angle prior art iron club head showing its center of gravity CG to the shaft axis distance to be 1.4 inches.

Figure 8B:
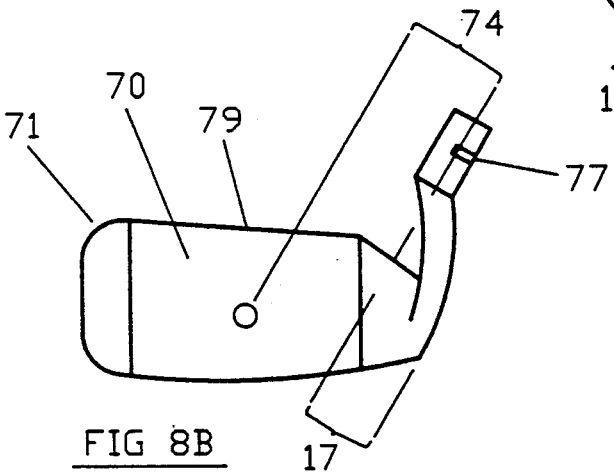
FIGS. 8B and 8C are two views of a 60 degree loft angle iron club head embodying the present invention.
Figure 8C:
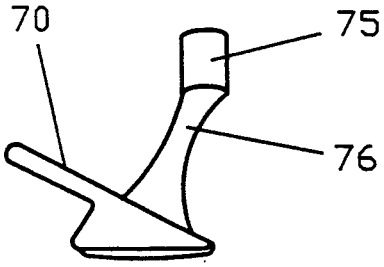

FIGS. 8B and 8C are two views of a 60 degree loft angle iron club head embodying the present invention. FIG. 8B is a front view of this 60 degree loft angle club head. The distance 74 is calculated to be 1.12 inches for the present invention's club head and this calculated distance should be compared to the measured distance of 1.4 inches for the prior art club head shown in FIG. 8A. Note that the top of the toe 71 shown in FIG. 8B is not much higher than the top of the club face at the heel end and that the entire club face 70 is closer to the shaft axis than on the prior art club head. The reason for the shallow rise 79, from the top of the heel club face to the top of toe, is to lower the club head CG. This shallow rise and low profile toe 71 not only lowers the club head CG, but reduces the distance 74 to obtain a lower axial inertia club head as discussed previously. The biggest contributor to obtaining a lower axial inertia club head is the mass 78 concentrated on the side of the shaft axis opposite to the impact side of said shaft axis. A cross section of this mass concentration 78 is shown in FIG. 10C. Optionally, and as shown in FIG. 8C, the hosel is configured such that the shaft axis will intersect a horizontal line which is located on the impact plane and where said horizontal line intersects the impact point. This optional configuration is shown in Table 1 with a leading edge progression of 0.19 inch. Leading edge progression is defined as the distance from the hosel centerline to the leading edge of the club face at its horizontal centerline. The club face 70 is shown without regard to any detail, since said detail is not important to this discussion. The hosel 75 and its connector 76 which are integral to the club head shall follow the extremity of the club head heel and is configured to limit thedistance 17 to 0.625 inch maximum. Optionally, a pin 77 may be used to help secure the shaft to the hosel. FIG. 8C is a toe end view of the 60 degree loft angle club head.

FIGS. 9A and 9B are two views of a 30 degree loft angle iron head embodying the present invention. FIG. 9A is a front view of the 30 degree loft angle iron club head. Note the shallower rise of the top of the club face, from the heel end to the toe end, when compared to the prior art club head shown in FIG. 8A. All iron club heads embodied in this invention shall feature the said shallow rise in order to obtain a low club head center of gravity. FIG. 9B is a toe end view of the 30 degree loft angle club head. Three sectional views of this club head are given in FIGS. 10A, 10B and 10C.

FIGS. 10A, 10B and 10C are three sectional views of the 30 degree loft angle club head shown in FIGS. 9A and 9B.

TABLE 1

SPECIFICATION FOR CLUB HEADS SHOWN IN FIGS. 5A THRU 9A

| | DRIVER FIG. 5A | DRIVER FIG. 6A | DRIVER FIG. 7A | IRON FIG. 8A | IRON FIG. 9A |
|---|---|---|---|---|---|
| LIE ANGLE | 54 Deg. | 54 Deg. | 54 Deg. | 64 Deg. | 60 Deg. |
| LOFT ANGLE | 11 Deg. | 11 Deg. | 11 Deg. | 60 Deg. | 30 Deg. |

TABLE 1-continued

| SPECIFICATION FOR CLUB HEADS SHOWN IN FIGS. 5A THRU 9A | | | | | |
|---|---|---|---|---|---|
| | DRIVER FIG. 5A | DRIVER FIG. 6A | DRIVER FIG. 7A | IRON FIG. 8A | IRON FIG. 9A |
| CLUB LENGTH | 43 In. | 43 In. | 43 In. | 35.5 In. | 37.5 |
| LEADING EDGE PROGRESSION | .80 In. | .56 In. | .13 In. | .19 In. | .24 In. |
| HEAD LENGTH | 3.25 In. | 3.25 In. | 3.25 In. | 3.5 In | 3.5 In |
| HEAD WIDTH | 2.75 In. | 2.25 In. | 2.25 In. | 1.4 In | 1.2 In |
| HEAD HEIGHT | 1.56 In. | 1.56 In. | 1.56 In. | 1.5 In | 1.5 In |
| FACE HEIGHT | 1.5 In. | 1.5 In. | 1.5 In. | 1.5 In | 1.5 In |
| ROLL RADIUS | 12 In. | 12 In. | 12 In. | 30 In. | 30 In. |
| BULGE RADIUS | 12 In. | 12 In. | 12 In. | 30 In. | 30 In. |
| SOLE RADIUS | 6 In. | 6 In. | 6 In. | 6 In. | 6 In. |
| CENTER OF GRAVITY: | | | | | |
| ABOVE SOLE | .53 In. | .60 In. | .65 In. | .51 In | .60 In. |
| FROM SHAFT AXIS | .67 In | .70 In | .80 In | 1.12 In | 1.12 In |
| BEHIND IMPACT PLANE | .77 In | .51 In. | .49 In. | .01 In | .09 In |

While a preferred embodiment of the present invention has been shown for a selected group of clubs in the drawings and Table 1, and described herein, many modifications thereof may be made by a person skilled in the art without departing from the spirit and scope of the present invention. The term axial inertia of the word inertia is defined for the present invention as rotational inertia about the club shaft longitudinal axis. Impact plane is defined for the present invention as a vertical plane which intersects the impact point and is perpendicular to the horizontal component of the golf ball launch direction. Shaft axis is defined for the present invention as the longitudinal axis of the golf club shaft or an extension thereof. The shaft axis is on a line with the hosel centerline.

What I claim is:

1. A golf club comprising a rigid club head, a shaft and a grip;

said club head being rigidly shaped to define a club face, a heel, a sole, a toe, a crown and a hosel;

said club face being adapted to strike a golf ball;

said club face having upper and lower edges, toe and heel boundary limits;

said heel being the portion of said club head where the sole and hosel meet;

said sole being the bottom surface of said club head and which normally rests on the ground when said golf club is held in the playing position;

said toe being the part of the club head that is the farthest away from said heel of said club head;

said crown being the curved top portion of said club head;

said hosel being that portion of said club head that is designed to interfit with said shaft;

said hosel being integrally attached to said club head in a manner to produce a hosel centerline to heel extremity distance of approximately 0.60 inch but not to exceed 0.625 inch;

said club head having a center of gravity located not more than 0.90 inch from the shaft axis centerline, not more than 0.40 inch behind a plane which is parallel to and intersects the shaft centerline and where said plane is parallel to a horizontal line traversing along said club face, not more than 0.70 inch above the sole;

said club head center of gravity location affording a low axial inertia golf club defined by having a torque limitation of not more than 6.44 oz-in about the hosel centerline when utilizing a club head weighing 7.15 ounces, said torque limitation adjusted by the dimensionless multiplying factor obtained by dividing the weight of the utilized club head in ounces by 7.15 ounces;

said grip being adhesively attached to said shaft; and said shaft being attached to said club head.

2. The golf club of claim 1, wherein the club face has a roll radius of 8 inches to 50 inches.

3. The golf club of claim 1, wherein the club face has a bulge radius of 8 inches to 50 inches.

4. The golf club of claim 1 wherein said hosel is of the offset type and where said club head center of gravity is located not more than 0.95 inch from the shaft axis centerline, not more than 0.49 inch behind said plane, not more than 0.75 inch above said sole;

said club head center of gravity location affording a low axial inertia golf club defined by having a torque limitation of not more than 6.79 oz-in about the hosel centerline when utilizing a club head weighing 7.15 ounces, said torque limitation adjusted by the dimensionless multiplying factor obtained by dividing the weight of the utilized club head in ounces divided by 7.15 ounces.

5. The golf club of claim 1 wherein the club head is of an iron type and where said iron type club head center of gravity is located not more than 1.35 inches from the shaft axis centerline, not more than 0.25 inch behind said plane, not more than 0.65 inch above said sole;

said club head center of gravity location affording a low axial inertia golf club defined by having a torque limitation of not more than 12.04 oz-in about the hosel centerline when utilizing a club head weighing 8.92 ounces, said torque limitation adjusted by the dimensionless multiplying factor obtained by dividing the weight of the utilized club head in ounces divided by 8.92 ounces.

* * * * *